US005261347A

United States Patent [19]

Mansfield

[11] Patent Number: 5,261,347

[45] Date of Patent: Nov. 16, 1993

[54] SAILBOAT DAVIT

[76] Inventor: Peter W. Mansfield, 511 59th St., Holmes Beach, Fla. 34217

[21] Appl. No.: 918,574

[22] Filed: Jul. 22, 1992

[51] Int. Cl.[5] ..... B63B 23/02

[52] U.S. Cl. ..... 114/368; 114/44; 114/268; 405/3

[58] Field of Search ..... 114/365, 44, 39.1, 39.2, 114/268, 368, 376, 99, 90–94; 405/1, 3; 254/264, 278

[56] References Cited

U.S. PATENT DOCUMENTS

| | | | |
|---|---|---|---|
| 2,045,603 | 6/1936 | Hyland | 114/376 |
| 3,045,839 | 7/1962 | Hibberd | 114/44 |
| 3,101,149 | 8/1963 | Hurst | 405/1 |
| 4,361,947 | 12/1982 | Arnaud | 114/90 |

FOREIGN PATENT DOCUMENTS

| | | | |
|---|---|---|---|
| 490709 | 2/1976 | U.S.S.R. | 114/268 |

*Primary Examiner*—Joseph F. Peters, Jr.
*Assistant Examiner*—Clifford T. Bartz
*Attorney, Agent, or Firm*—Charles J. Prescott

[57] ABSTRACT

A sailboat davit connectable into the ground adjacent a seawall, water's edge or other like supportive objects for lifting and lowering a small sailboat. The device includes an elongated upright support member having a radially outwardly extending boom connected at one end to the upper end of the upright support member. A generally horizontal spreader beam is connected at a mid-point thereof to the distal end of the boom so that the spreader beam extends in either direction preferably from a plane generally defined by the upright support member and the boom. A flexible cable and pulley arrangement, winch-activated, is provided having a flexible cable downwardly extending over a pulley at each end of the spreader beam, each end of each cable being connectable to the sailboat hull whereupon the sailboat is lifted and lowered in response to winch activation. A preferably U-shaped bracket is connected at one end of the spreader beam structured to slidably engage around the sailboat mast to maintain the sailboat in upright orientation during lifting and lowering.

7 Claims, 1 Drawing Sheet

M
24
24
20
46
22
32
28
34
18
36
40
38
26
B
36
50
26
30
44
48
10
42
E
G
12
F
44
14
S
16

SAILBOAT DAVIT

BACKGROUND OF THE INVENTION

This invention generally relates to lifting devices, and more particularly to a uniquely configured davit for lifting a small sailboat from and into the water.

Davits are well-known for lifting various types of vessels from the water for storage. These davits are positioned either along the water's edge in the ground, or more typically within a reinforced concrete seawall adjacent the water's edge. Davits are also utilized on larger boats and ships for lifting small boats and dinghies from the water to be carried by the larger vessel.

Davits are typically in the form of an upright support member, radially or diagonally outwardly extending boom and a cable and winch arrangement for lifting and lowering the boat which is connected at the end of the cable. Alternately, for somewhat larger boats, a tandem arrangement of two such davits may be utilized, one connected by cable at each end of the boat.

The lifting of small sailboats from the water by davit is, however somewhat more difficult. Because of the mast location and relatively large, elevated center of gravity, lifting of sailboats is normally accomplished by two davits in tandem or by expensive carriage arrangements. This is, in part, because the weight of the mast tends to make maintaining the sailboat in an upright orientation when lifted from the water somewhat difficult and precarious at best.

Further, such arrangements for lifting small sailboats from the water presently available are relatively expensive with respect to the investment in the sailboat and therefore make the cost/benefit factor unappealing to most owners of such vessels.

The present invention provides a sailboat davit which is relatively inexpensive to manufacture and, by utilizing a single such davit, a small sailboat may be lifted and lowered back into the water while fully stabilizing the mast in its upright orientation and while maintaining pitching stability of the sailboat.

BRIEF SUMMARY OF THE INVENTION

This invention is directed to a sailboat davit connectable into the ground adjacent to a seawall, water's edge or other like supportive objects for lifting and lowering a small sailboat. The device includes an elongated upright support member having a radially outwardly extending boom connected at one end to the upper end of the upright support member. A generally horizontal spreader beam is connected at a mid-point thereof to the distal end of the boom so that the spreader beam extends in either direction preferably from a plane generally defined by the upright support member and the boom. A flexible cable and pulley arrangement, winch-activated, is provided having a flexible cable downwardly extending over a pulley at each end of the spreader beam, each end of each cable being connectable to the sailboat hull whereupon the sailboat is lifted and lowered in response to winch activation. A preferably U-shaped bracket is connected at one end of the spreader beam structured to slidably engage around the sailboat mast to maintain the sailboat in upright orientation during lifting and lowering.

It is therefore an object of this invention to provide an economical sailboat davit for small to medium-sized sailboats which will lift and lower the sailboat while fully stabilizing the sailboat from unwanted movement.

It is yet another object of this invention to provide an economical sailboat davit for small to medium-sized sailboats which is easily connectable into the ground, a seawall or onto the deck or similar structure of a floating vessel.

It is yet another object of this invention to provide an economical sailboat davit which is easily adjustable with respect to the length variations of small sailboats.

It is yet another object of this invention to provide an economical sailboat davit which will also function as a conventional lifting davit, if desired.

In accordance with these and other objects which will become apparent hereinafter, the instant invention will now be described with reference to the accompanying drawings.

DETAILED DESCRIPTION OF THE INVENTION

Figure 1:
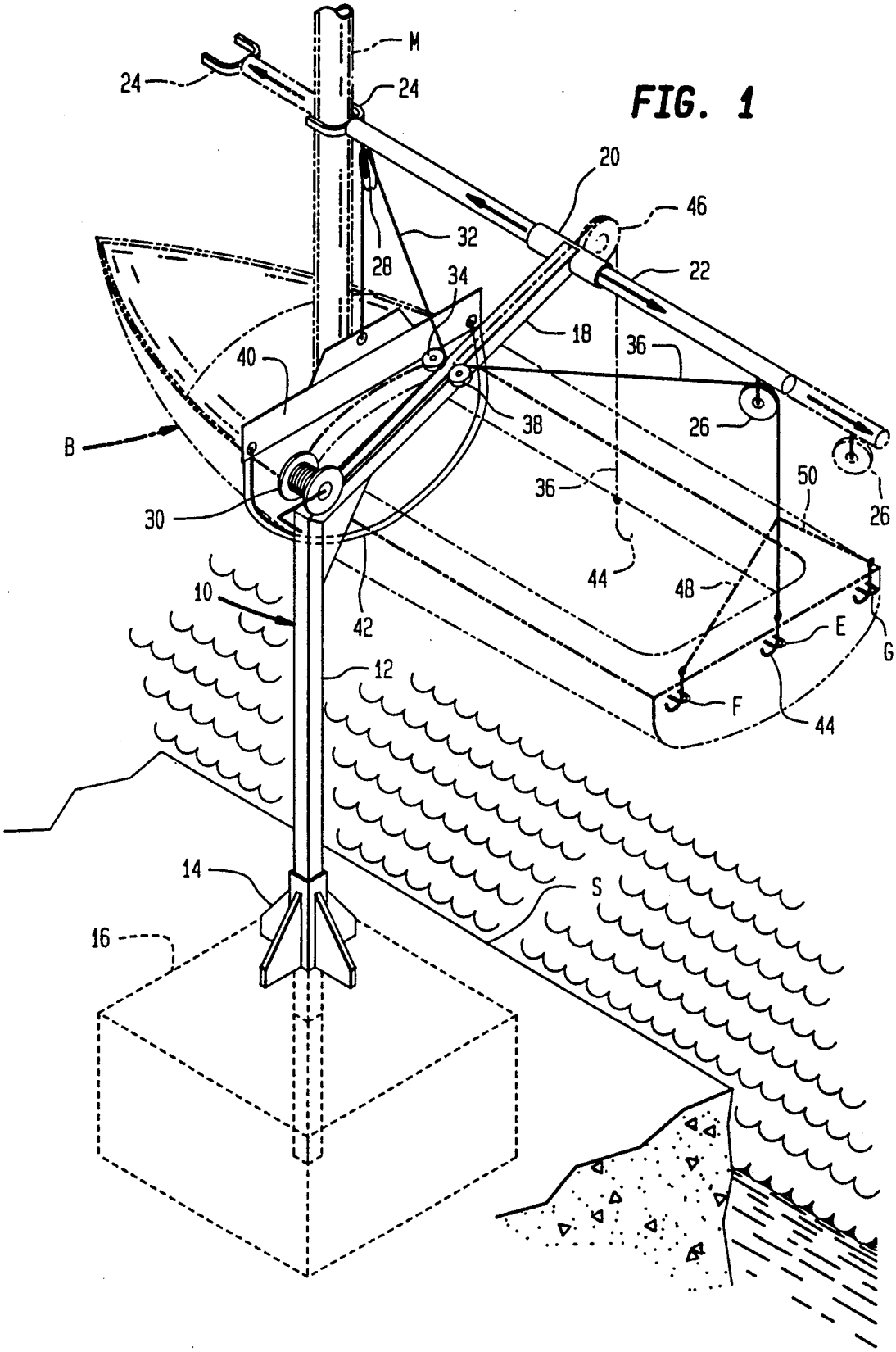
FIG. 1 is a perspective view of the preferred embodiment of the invention showing an optional telescopic feature in conjunction with a small to medium sailboat, both in phantom.

Referring now to FIG. 1, the invention is shown generally at numeral 10 in use with respect to a small or medium-sized sailboat shown generally at B. The invention 10 includes a rigid elongated upright support member 12 connected into a seawall S by buried concrete anchor 16 and further stabilized by braces 14.

The device 10 also includes a rigid, elongated boom 18 which is connected at its lower end to the upper end of upright support member 12 with suitable gussets or bracing for strength and rigidity. A tubular sleeve 20 is rigidly connected at the distal end of boom 18 and oriented axially so as to be horizontal and generally perpendicular to the upright plane defined by upright support member 12 and boom 18.

A spreader beam 22 is slidably and then lockably engagable within support tube 20 so as to adjustably positionable axially back and forth in the direction of the arrows. A first pulley 26 is operably connected to one end of the spreader beam 22, while a second pulley 28 is operably connected adjacent the other end of spreader beam 22 as shown. A winch 30, manual or power assisted, is connected to the lower end of boom 18 having one portion of a pair of flexible cables 32 and 36 wound therearound in the same direction. Cable 36 extends around intermediate pulley 34 connected to the boom 18 and then around and downward from the second pulley 28. Cable 36 extends from the winch 30 around intermediate pulley 38 connected to the boom 18 and then over and downward from the first pulley 26.

The distal end of cable 32 includes an elongated rigid transverse spreader beam 40 having a flexible sling 42 connected at each end to each end of the spreader beam 40. This sling 42 is sized so as to conformingly wrap around and supportively engage the hull of the sailboat B as shown. The distal end of cable 36 includes a hook or snap 44 appropriately structured to engage an eyelet E connected into the transom of the boat B. Alternately, the end of cable 36 may be fitted with a yoke arrangement including two spreadable cable end segments 48 and 50 engagable by hooks or snaps into spaced transom eyelets F and G to accommodate a particular sailboat transom configuration.

By the arrangement thus described, sling 42 may be supportively engaged around the lower surface of the hull of the boat B or, alternately, spreader beam 40 may be connected at each end directly to the deck with two hooks or snaps similar to that described as hook 44, while hook 44 may be engaged into the transom eyelet E of the sailboat B. Thereafter, by activating winch 30, the sailboat B may be lifted and lowered with respect to the water.

To stabilize the sailboat B from rolling motion, a U-shaped bracket 24 is provided connected and axially extending from one end of the spreader beam 22 adjacent the second pulley 28 as shown. This bracket 24 is structured to engage around the mast M of the sailboat B in sufficient proximity to the mast so as to prevent any rolling or lateral movement or pitching movement of the mast M. However, as the sailboat B is raised and lowered, the mast M will freely slide within bracket 24, yet be maintained in a stable supported relationship to the bracket 24.

In addition to being adjustable axially, spreader beam 22 may be telescopically extendable at each end in the direction of the arrows in phantom and as shown in phantom. This telescopic adjustability is optionally provided to accommodate various sized small sailboats.

An optional pulley shown in phantom at 46 may be provided operably connected to the distal end of boom 18 so that the first cable 36 having a hook 44 connected thereto, may be alternately utilized as a conventional davit.

It should be understood that, by connecting each cable 32 and 36 onto the same winch 30, the activation of the winch 30 will provide equal lifting and lowering movement at each end of these cables 32 and 36 to help insure maintaining the sailboat B in a horizontal orientation as it is raised and lowered.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A sailboat davit comprising:

an elongated upright support member connectable at a lower end thereof to the ground;

an outwardly extending elongated boom connected at one end to an upper end of said upright support member and having a generally horizontal elongated spreader beam connected to and extending generally orthogonally in either direction from a distal end of said boom;

a flexible cable and winch arrangement connected to said boom near said upright support member structure having a first flexible cable controlledly downwardly and upwardly extendable by said winch from a first pulley operably connected to said spreader beam in the vicinity of a first end of said spreader beam and a second flexible cable controlledly downwardly and upwardly extendable by said winch from a second pulley operably connected to said spreader beam in the vicinity of a second end of said spreader beam;

a distal end of said first and said second cables including an arrangement cooperatively structured to supportively engage a hull of a sailboat, the sailboat then being lifted and lowered in response to controlled activation of said winch;

means connected to said spreader beam second end for supportively engaging and stabilizing a mast of the sailboat in a generally upright orientation during lifting and lowering of the sailboat.

2. A sailboat davit as set forth in claim 1, wherein:

said spreader beam is axially positionable back and forth with respect to said boom.

3. A sailboat davit as set forth in claim 1, further comprising:

a central pulley operably connected to said boom in the vicinity of said boom distal end and structured to supportively receive said first cable.

4. A sailboat davit as set forth in claim 1, wherein:

said mast supporting and stabilizing means slidably engages along the length of the mast as the sailboat is raised and lowered by said winch.

5. A sailboat davit as set forth in claim 1, wherein:

said spreader beam is telescopically extendable axially in either direction with respect to said boom.

6. A sailboat davit as set forth in claim 4, wherein:

said spreader beam is sized in length with respect to the sailboat to position said first pulley generally above a transom of the sailboat and to position said mast supporting and stabilizing means immediately adjacent the mast.

7. A sailboat davit as set forth in claim 4, wherein:

said mast supporting and stabilizing means is a U-shaped bracket sized to fit around the mast.

* * * * *